US005558545A

United States Patent [19]

Staab et al.

[11] Patent Number: 5,558,545

[45] Date of Patent: Sep. 24, 1996

[54] BATTERY TERMINAL CONNECTOR HAVING PAD CONTACTS

[75] Inventors: Jeanne E. Staab, Warren; Edward M. Bungo, Cortland; Robert J. Stang, Courtland, all of Ohio

[73] Assignee: General Motors Corporation, Detroit, Mich.

[21] Appl. No.: 431,944

[22] Filed: May 1, 1995

[51] Int. Cl.[6] ..... H01R 4/42

[52] U.S. Cl. ..... 439/762; 439/433

[58] Field of Search ..... 439/433, 762, 439/763, 764

[56] References Cited

U.S. PATENT DOCUMENTS

| | | | |
|---|---|---|---|
| 1,759,043 | 5/1930 | Derby | 439/762 X |
| 2,751,571 | 11/1953 | Colyer | 339/228 |
| 4,354,726 | 10/1982 | Kato et al. | 439/763 |
| 5,087,214 | 2/1992 | Dewar | 439/762 |
| 5,183,419 | 2/1993 | Dewar | 439/765 |
| 5,302,142 | 4/1994 | Tabata | 439/762 OR |
| 5,498,178 | 3/1996 | Tabata | 439/762 OR |

*Primary Examiner*—P. Austin Bradley
*Assistant Examiner*—Daniel Wittels
*Attorney, Agent, or Firm*—William A. Schuetz; Cary W. Brooks

[57] ABSTRACT

A battery terminal connector has a hollow cylindrical gripping portion which is axially slit and which has raised radially inwardly extending pads which are knurled for biting into a top battery post when the gripping portion is tightened around the battery post.

5 Claims, 2 Drawing Sheets

BATTERY TERMINAL CONNECTOR HAVING PAD CONTACTS

The present invention relates to a battery terminal connector and, more particularly, to a battery terminal connector having a gripping portion provided with three radially inwardly extending pads at three equidistantly spaced circumferential locations for gripping a battery post when clamped thereto.

Heretofore battery terminal connectors for connecting an electrical cable to a battery post have comprised elastically deformable gripping portions which were axially slit so that the gripping portion could be opened and closed around the battery post. It is also known to provide a large number of radially inwardly extending and axially extending indentations at spaced circumferential locations in the gripping portions of such a battery connector for engaging the battery posts. U.S. Pat. No. 4,354,726, issued Oct. 19, 1982, shows the latter type of battery terminal connector.

It has been found that when a battery terminal connector which has an axially slit cylindrical or hollow gripping portion is clamped onto a battery post, that the clamping forces are primarily located at three circumferentially spaced locations around the battery posts. Based on this, Applicants have devised a novel battery terminal connector in which the axially slit gripping portion is provided with three equidistant, circumferentially spaced, radially inwardly extending pads or indentations which grip the battery post at three circumferential locations when the gripping portion is clamped thereto. Another novel feature is that the pads have an interface which is coplanar with the inner wall of the gripping portion and which is knurled so that the knurls in the face of the pads dig into the battery post to enhance both the mechanical and the electrical connection thereto.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
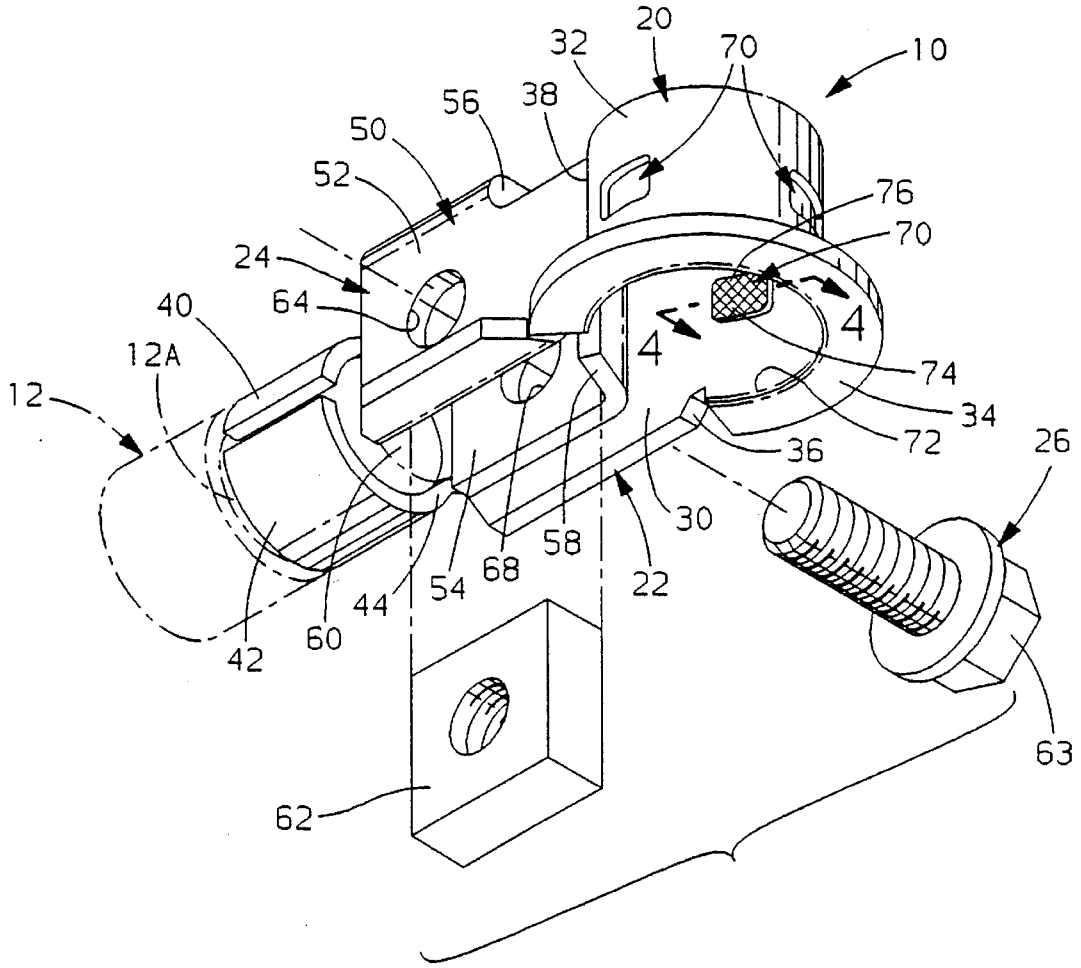
FIG. 1 is a perspective view of a novel battery terminal connector embodying the present invention.

Referring to the drawings, a novel battery terminal connector 10 is thereshown for connecting an electrical cable 12 to a top post battery terminal 14 of a battery 16.

The battery terminal connector 10 comprises, in general, a gripping portion 20 for clamping onto the top post 14 of the battery 16, a first extension arm 22 for clamping onto an electrical cable 12, a second extension arm 24 which extends generally parallel to the first extension arm 22 and which serves as a nut carrier for a fastener means 26 carried by the extension arms 22, 24 for fastening the gripping portion 20 onto the battery post 14.

The battery terminal connector 10 is made from a suitable elastically deformable and electrically conductive metal material, preferably copper. The gripping portion 20 is axially slit, as indicated by reference numeral 30, and is in the shape of a hollow cylinder. The gripping portion 20 has an annular side wall 32 and a radially outwardly extending flange 34 at its lower end. The gripping portion 20 at its ends 36, 38 is integral with the extension arms 22, 24, respectively.

Figure 2:
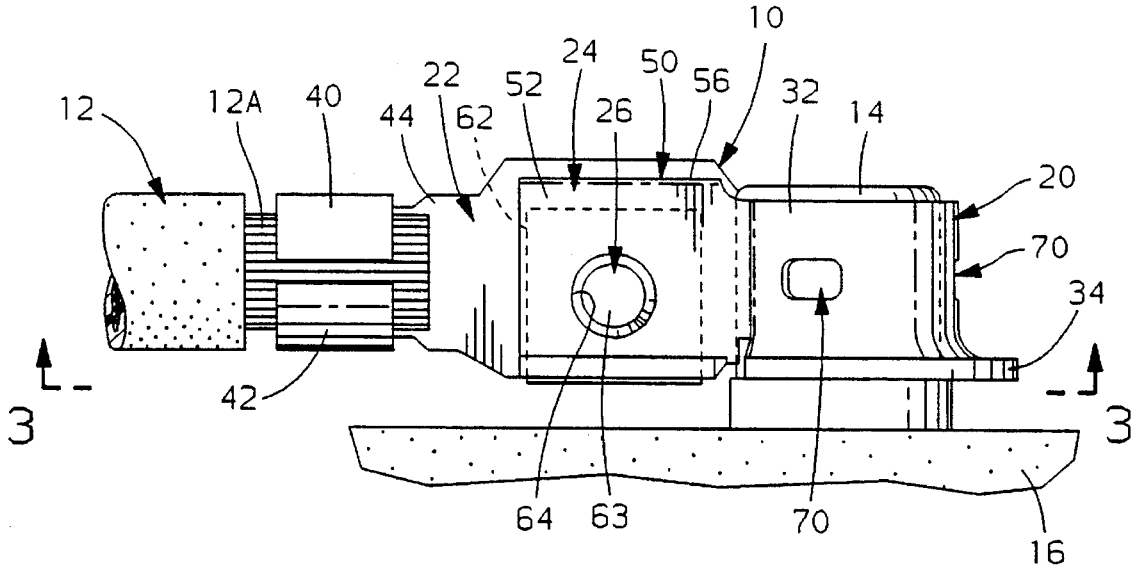
FIG. 2 is a side elevational view of the battery terminal connector shown in FIG. 1 and showing the same attached to a battery post.

The extension arm 22 is planar and has a pair of crimping wings 40, 42 at its end remote from the gripping portion 20. The crimping wings 40, 42 along with a bottom 44 of the extension arm 22 at their inner surfaces adjacent the crimping wings 40 are knurled (not shown). The crimping wings 40, 42 are adapted to be crimped around the stripped end or core 12A of a suitable electrical cable 12, as shown in FIG. 2.

The extension arm 24, which extends generally parallel to the extension arm 22 is bent and shaped to define a U-shaped nut carrier 50. The U-shaped nut carrier 50 comprises a pair of spaced side walls 52, 54 and an intermediate bight portion 56. The side walls 52, 54 are parallel to each other. The wall 54 also includes an end wall 58 adjacent the gripping portion 20. The U-shaped nut carrier 50 thus has an open bottom side 60 for receiving a nut 62 of the fastener means 26. The fastener means 26 comprises a headed bolt 63 which extends through aligned openings 64 and 66 and 68 in the extension arm 22 and the sides 52, 54 of the nut carrier 50 of the extension arm 24, respectively. The headed bolt 63 is threaded and is threadably secured to the nut 62 which is positioned within the U-shape nut carrier 50. The side wall 58 serves to prevent the nut 62 from rotating when the fastener means 26 is tightened to clamp the gripping portion 20 of the battery terminal connector 10 onto the battery post 14.

Figure 3:
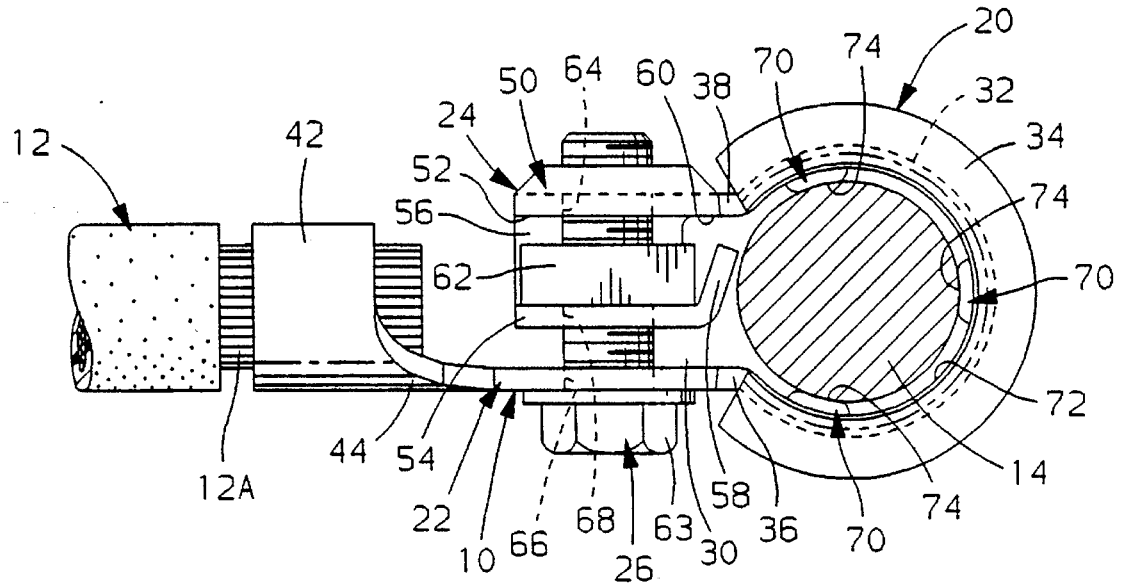
FIG. 3 is a cross sectional view taken approximately along line 3—3 of FIG. 2.
Figure 4:
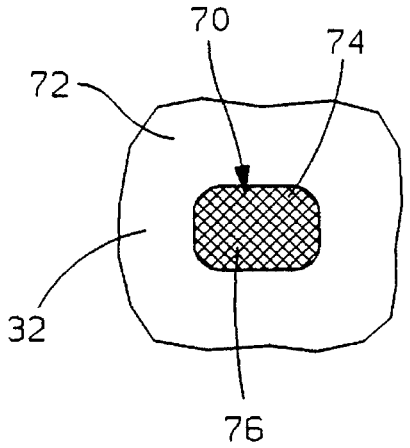
FIG. 4 is an enlarged fragmentary side elevational view taken approximately along line 4—4 of FIG. 1.

As best shown in FIGS. 1 and 3, the gripping portion 20 of the battery terminal connector 10 has three raised pads 70 for engaging the battery post 14. The raised pads 70, in the preferred embodiment, are rectangular in shape, as shown in FIG. 4, and are formed by indenting the side wall at three equidistant circumferentially spaced locations. The raised pads 70 are located approximately midway between the upper and lower ends of the gripping portions 20. The raised pads 70 extend radially inwardly from the inner side wall surface 72 of the gripping portion 20 and have an inner end face 74 which is coplanar with the side wall surface 72 of the gripping portion.

Another feature of the raised pads 70 is that they are knurled at their radially inwardly extending end face 74, as indicated by reference numeral 76 so that the raised pads 70 will bite into the battery post 14 when connected thereto.

Figure 5:
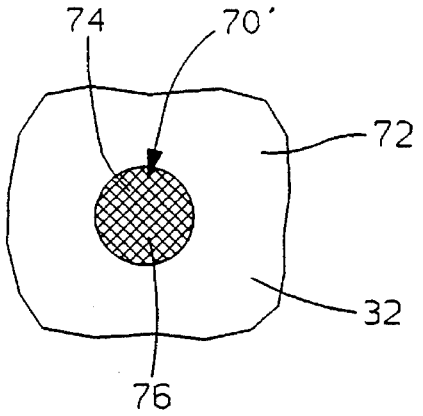
FIG. 5 is a view similar to that shown in FIG. 4, but showing an alternative configuration for the pad of the battery terminal connector.

FIG. 5 shows an alternative embodiment for the raised pads 70' in that the pads are circular in shape rather than rectangular. In other respects the raised pads 70' are identical.

From the foregoing, it should be apparent that the nut 62 is cradled in the nut carrier 50 and threadably receives the bolt 63. The battery terminal connector 10 can be connected to the battery post 14 by sliding the same thereover and with the radially extending flange 34 engaging the battery 16 at its top surface. The battery terminal connector 10 is thereafter connected to or closed around the post 14 by tightening the bolt 63 of the fastener means 26 to draw the extension arms 22, 24 toward one another so that the raised pads 70 engage the battery post 14 at three equidistantly spaced circumferential locations and with the knurls 76 of the pads 70 biting into the post 14 to provide both a good or solid electrical and mechanical connection thereto. It should also be noted that overtightening cannot occur due to the fact that the wall 54 of the extension arm 24 will engage the extension arm 22.

From the foregoing it should be apparent that a simple and highly effective battery terminal connector for connecting to a top post battery has been provided. Although the battery terminal connector 10 and battery post 14 are illustrated in the drawings as being cylindrical, they could also be of a tapered, truncated cone shape.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. A battery terminal connector for connecting an electrical cable to a battery terminal post, said connector comprising:

a gripping portion formed of elastically deformable and electrically conductive metal material in the shape of a hollow shell having adjacent ends which define and axially extending slot to enable the shell to open and close, a pair of extension arms integral with said ends of said shell and extending generally parallel to one another, first of said arms being connectable to an electrical cable, radially inwardly extending indentations on said gripping portion for engaging said battery post at spaced locations, and fastener means carried by said extension arms for moving said extension arms toward each other to close said gripping portion around said battery post to clamp said indentations and gripping portion onto said battery post, the improvement being that said indentations comprise three radially inwardly extending pads at three equidistantly spaced circumferential locations on said gripping portion, said pads having an inner end face which is knurled so that said pads bite into the battery post to provide both a good mechanical and a good electrical connection with the battery post.

2. A battery terminal connector, as defined in claim 1, and wherein said pads are rectangular in shape and spaced approximately midway between the upper and lower ends of the gripping portion.

3. A battery terminal connector, as defined in claim 1, and wherein said pads are circular in shape and spaced approximately midway between the upper and lower ends of the gripping portion.

4. A battery terminal connector, as defined in either claim 2 or 3, and wherein the inner end faces of the pads are coplanar with the inner wall surface of the remainder of the gripping portion.

5. A battery terminal connector, as defined in claim 4, and wherein the other extension arm is bent into a U-shaped cradle portion to define a pair of spaced walls and a bight at one of the walls, and wherein one of the walls is also bent to provide a transversely extending flange which extends toward the other wall, said walls of said other extension arm and said first extension arm having aligned openings therethrough for receiving a bolt of said fastener means, said U-shaped cradle receiving a nut of said fastener means threaded to said bolt and with the transverse flange preventing the nut from rotating when the bolt is tightened to clamp the gripping portion to the battery terminal post.

* * * * *